US006152865A

United States Patent [19]

Beauvoir

[11] Patent Number: 6,152,865

[45] Date of Patent: Nov. 28, 2000

[54] MUSCLE EXERCISE AND STRENGTHENING DEVICE

[76] Inventor: Bruno Beauvoir, Chalet l'Edelweiss, Le Lachat, 74230 Thones, France

[21] Appl. No.: 09/105,841

[22] Filed: Jun. 26, 1998

[30] Foreign Application Priority Data

Jul. 1, 1997 [FR] France ..... 97/08559

[51] Int. Cl.[7] ..... A63B 26/00

[52] U.S. Cl. ..... 482/140; 482/83; 482/105; 482/124; 482/129; 482/130

[58] Field of Search ..... 482/140, 83, 86–90, 482/110, 105, 115–117, 123, 124, 129, 130

[56] References Cited

U.S. PATENT DOCUMENTS

| | | | |
|---|---|---|---|
| 757,041 | 4/1904 | Hosfeld | 473/215 |
| 3,157,961 | 11/1964 | Payne | 46/51 |
| 4,871,178 | 10/1989 | Diaz | 273/411 |
| 5,098,089 | 3/1992 | Harrington et al. | 482/140 |
| 5,591,089 | 1/1997 | Huffines | 473/215 |

FOREIGN PATENT DOCUMENTS

| | | |
|---|---|---|
| 92 15 629 U | 3/1993 | Germany . |
| 2293554A | 4/1996 | United Kingdom . |

*Primary Examiner*—Michael A. Brown
*Assistant Examiner*—Lori Baker-Amerson
*Attorney, Agent, or Firm*—Fay, Sharpe, Fagan, Minnich & McKee, LLP

[57] ABSTRACT

A working element, such as a ball (4) is held at a preselected position in front of a user exercising abdominal muscles. The ball is supported (9, 31*a*, 31*b*, 44) by a positioning device (6) for positioning lower members of the user. The lower member positioning device includes at least one of a user knee positioning member (11, 15, 74) and a foot or ankle positioning member (10). A frame or other connecting element (21, 22, 40, 42, 61, 71) interconnects the foot and knee positioning elements in a preselected relationship. A flexible or spring mounting (14) or flexible straps (31*a*, 31*b*, 44) permit the ball (4) to be resiliently displaced during exercise.

8 Claims, 7 Drawing Sheets

MUSCLE EXERCISE AND STRENGTHENING DEVICE

BACKGROUND OF THE INVENTION

The present invention relates to the art of muscle exercise and strengthening devices. It finds particular application for working out abdominal muscles in gym settings for athletic practice, in kinesitherapy departments for functional rehabilitation, and the like. It is to be appreciated that the invention will also find application in other exercise and muscle strengthening environments.

Numerous appliances are known for exercising abdominal muscles. However, these prior appliances frequently call for repetitive movement and have a lack of diversity in the exercises performed. By nature, these appliances present a formidable deterrent to their use.

The present invention overcomes these drawbacks by providing a simple, reliable, sportive device.

SUMMARY OF THE INVENTION

In accordance with the present invention, a muscular exercise device for exercising abdominal muscles of a user is provided. It includes a working element and a means for positioning the working element. It further includes a means for positioning lower members of the user.

In accordance with a more limited aspect of the present invention, the working element includes a ball.

In accordance with another more limited aspect of the present invention, the means for positioning lower members of the user includes a device for positioning the feet or ankles of the user.

In accordance with another specific embodiment of the present invention, the means for positioning the lower members includes a device for positioning the knees of the user.

In accordance with another specific embodiment of the present invention, the knee positioning device includes a transverse strut for positioning inside the bend of the knee and a means for fixing the strut in this position.

In accordance with another aspect of the present invention, the means for positioning lower members includes a device for positioning the pelvis of the user.

In accordance with another more limited aspect of the present invention, the working element positioning means is adjustable.

In accordance with another aspect of the present invention, the muscle exercise device includes a support surface for supporting the user's back.

In accordance with another aspect of the present invention, the muscle exercise device includes an inclination means or ramped support surface.

One advantage of the present invention resides in its versatility. A wide variety of exercises are performable.

Another advantage of the present invention is that it reduces user boredom.

Other advantages of the present invention reside in its simplicity and reliability.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1A:
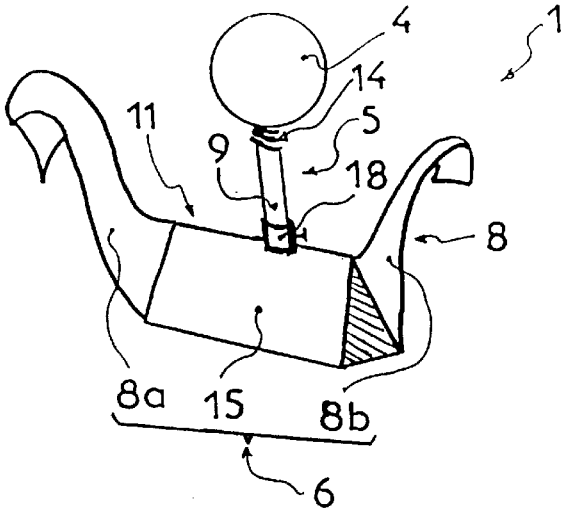
FIG. 1*a* is a perspective view of a first embodiment of muscle exercise device in accordance with the present invention.
Figure 1B:
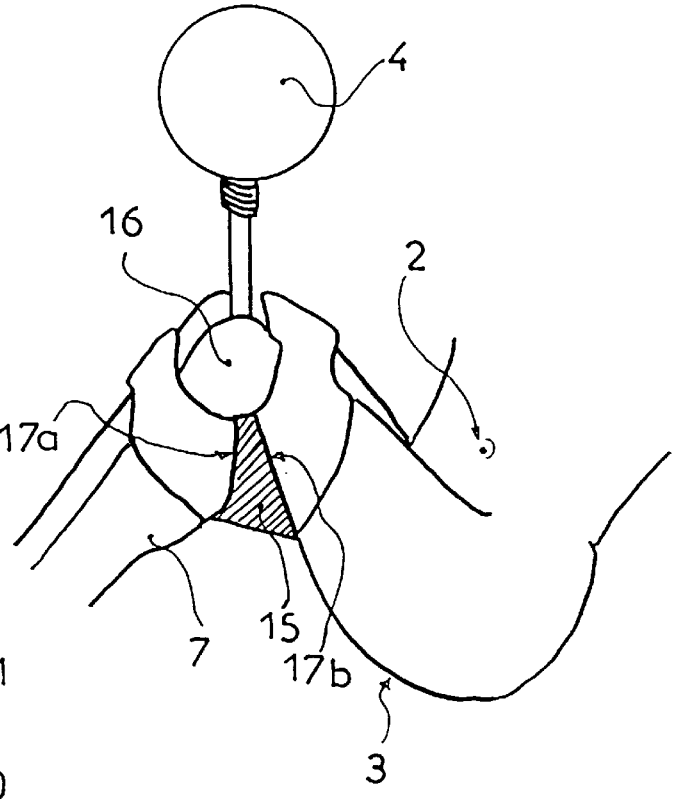
FIG. 1*b* is a perspective view of the embodiment of FIG. 1*a* as attached to the knees of a user.

With reference to FIGS. 1*a* and 1*b*, a muscle exercise device 1 includes a working element, such as a ball 4. The ball 4 is positioned in a zone, called the working zone, by a positioning means 5. The exercise device also includes a lower member positioning means 6 for positioning at least one part of the lower member 7 of a user 3. This permits the device to be installed in a position in which the user can perform exercises optimizing, for example, the workout of the abdominal muscles.

In alternate embodiments, the lower member positioning means is configured to engage different portions of the lower members, such as the ankle or foot positioning device 10, the knee positioning device 11, or the pelvis 12. In some embodiments, the device can also include a back support 13 for engaging the back of the user to permit dorsal support when the user is in a reposed position.

The device permits a workout of muscles, particularly the abdominal muscles, including movement between an inactive position of repose where the muscles are relaxed and an active work position.

The work element ball 4 is positioned by the positioning means 5 in such a manner that when the user is in the active work position, the ball is positioned to be held, pushed, punched, evaded, or the like. Due to this flexibility, the user can engage in workouts to exercise different muscles while at the same time, bestowing a playful aspect to the exercises.

This also combines abdominal exercises with upper member muscle exercises.

Although the working element is described as a ball in the various embodiments, it is to be understood that the work element can be a different shaped element without departing from the protected field of this invention.

With reference to FIGS. 1*a* and 1*b*, a first embodiment of the muscle exercise device 1 is designed to be placed directly on the user. It is fixed in a passive manner by a fixation means 8 or in an active manner by muscular effort of the user. In this embodiment, the device is designed to be placed off the ground.

The ball 4 is mounted on a positioning means which includes a stem 9 connected to the ball by a connection means 14, such as a spring. The stem and connection means preferably has a sufficient degree of flexibility to permit movement of the ball to the side and spring it back to its initial position. The degree of flexibility can vary over the length of the stem and is preferably controllable. The stem 9 is fixed to a transverse strut 15 shaped to be received behind the user's knees 16 with the stem 9 passing between the knees and the strut inside the fold of the knees. The fixation means 8 includes two retainer straps 8*a*, 8*b* one of which wraps around and immobilizes the user's tibias against a lateral wall 17*a* of the strut and the other strap wraps around an immobilizes the user's thighs against a lateral wall 17*b* of the strut. The transfer strut 17 and the fixation means 8*a*, 8*b* constitute a device which positions the knees and consequently positions the lower members 6. Alternately, the transverse strut need not include fixation means but may be held in the fold of the knees by muscular action of the user.

It should be noted that in this first embodiment, the transverse strut is preferably of a prismatic shape. In the longitudinal plane, it forms a triangular prism of substantially constant cross-section. The lateral wall 17*a*, 17*b* of the strut defines and angle called a flexation angle that is received below the knees. The flexation angle is preferably chosen between 25° and 140°. Although not illustrated, the transverse strut may include a control means for controlling the flexation angle to permit the user to adjust the flexation position of the knees as desired. In addition, the strut 15 includes a foam layer located along the lateral walls to improve the user's comfort during the performance of the exercises. Further, the muscle exercise device can include an adjustment means for adjusting the height of the ball. For example, a tube 18 which extends into the interior of the strut slidably receives the stem 9. A lock such as cotter pins received in mating bores in the stem and the strut, a threaded clamp, or the like adjust the degree to which the stem 9 is received in the tube 18, hence the height of the ball 4.

Figure 2:
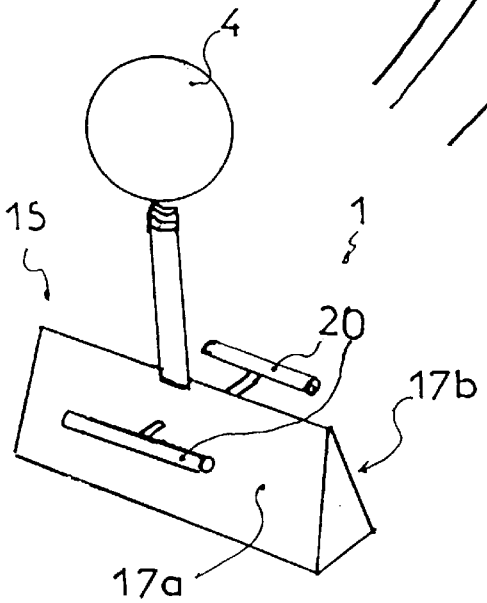
FIG. 2 is a perspective view of an alternate embodiment.

In the embodiment of FIG. 2, the fixation means includes a pair of T-shaped elements 20 which extend from the lateral walls 17*a*, 17*b* of the transverse strut 15. The cross bars of the T are spaced an appropriate distance from the lateral walls to engage and hold the tibias and thighs against the lateral walls.

Figure 3:
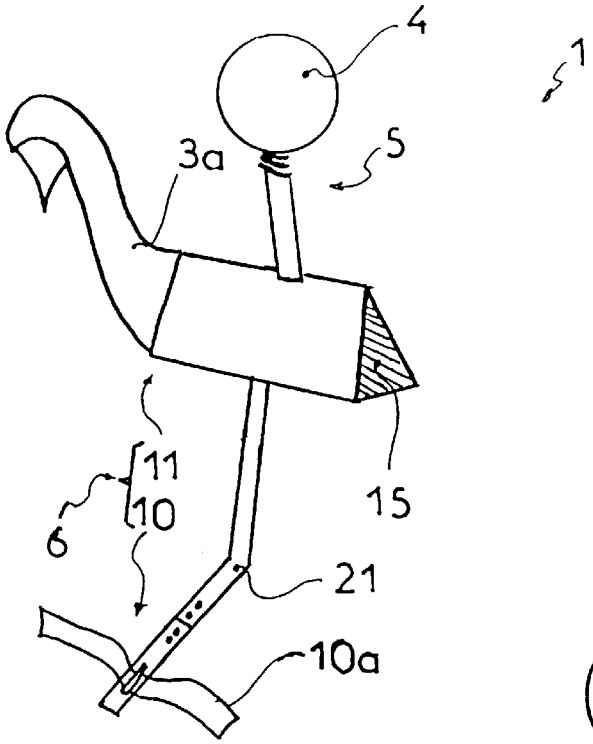
FIG. 3 is a perspective view of yet another alternate embodiment.

With reference to FIG. 3, in another variation of this embodiment, the lower member positioning means 6 again includes the strut 15 and a thigh strap 3*a*. Further, the lower member positioning means includes a foot positioning means, such as straps 10*a*. A connection element, such as a tube 21 that is bent and adjustable in length extends below the strut 15 to the foot straps 10*a*. It is to be noted that the transverse strut 15 is again positioned under the knees of the user, but may have a shape other than that of a triangular prism without departing from the present invention.

Figure 4:
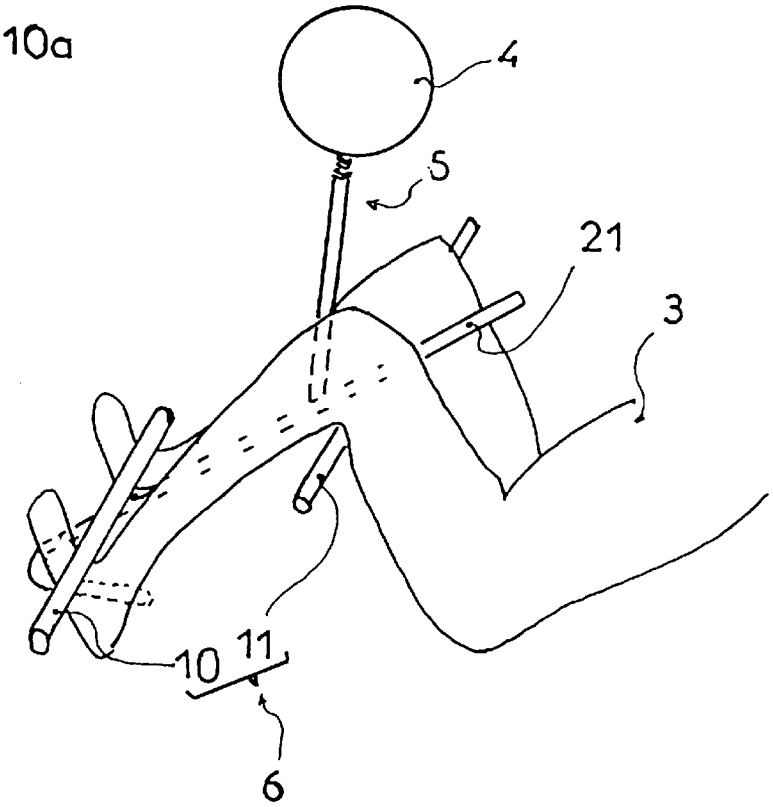
FIG. 4 illustrates yet another alternate embodiment in combination with a user.

With reference to FIG. 4, the lower member positioning means includes a foot positioning device 10 and a knee positioning device 11. In this embodiment, the knee positioning device is a transverse support bar that is positioned under the user's knees and over the user's feet. A tube 21 interconnects the foot and knee positioning devices and is connected with the ball positioning means 5. Preferably, the connections are adjustable to accommodate users of different sizes and to adjust the height and position of the ball 4, hence the height and position of the work zone. In the embodiment of FIG. 4, the user's feet pass below the support bar and the knees above it. However, it is to be appreciated that this could be reversed with the legs wedged between the support bars under the feet and over the knees.

Figure 5:
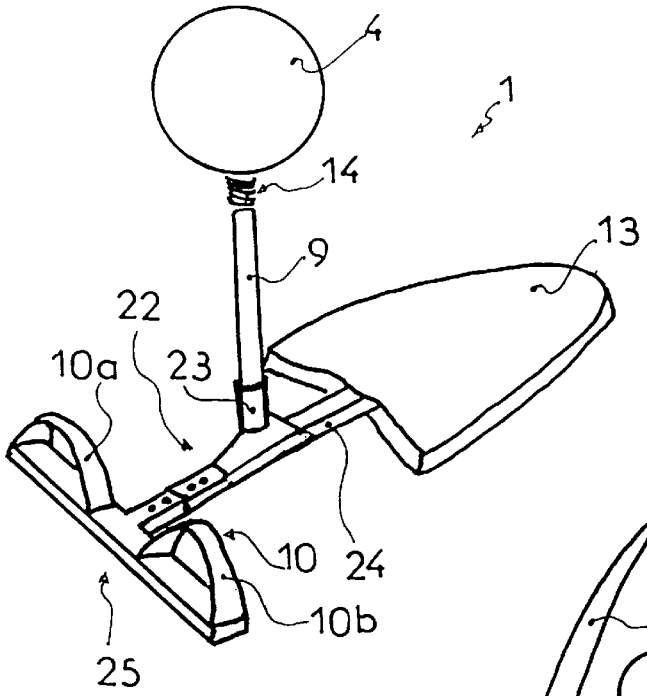
FIG. 5 is a perspective view of another embodiment.

With reference to FIG. 5, the exercise device 1 includes a ball 4 mounted on a stem 9 by a connection means 14. The stem is adjustable in height relative to a frame 22 of the device. The frame 22 includes a tube segment 23 which extends upward and vertically to receive the ball carrying stem 9 in a slidable and locking manner. The tube section 23 is mounted to a longitudinal bar 24 which carries foot positioning elements 10 at one end.

The longitudinal bar 24 is preferably made in two slidingly received parts which are bolted or otherwise selectively connected together to adjust the longitudinal distance between the ball receiving tube part 23 and the foot receiving elements 10. This embodiment further includes a back support 13 which is mounted to an opposite end of the longitudinal bar 24. The back support 13 is preferably configured with an appropriate anatomical shape to provide dorsal support. Alternately, the foot support elements may take the form of two flexible straps mounted on a transverse support bar 25.

Figure 6:
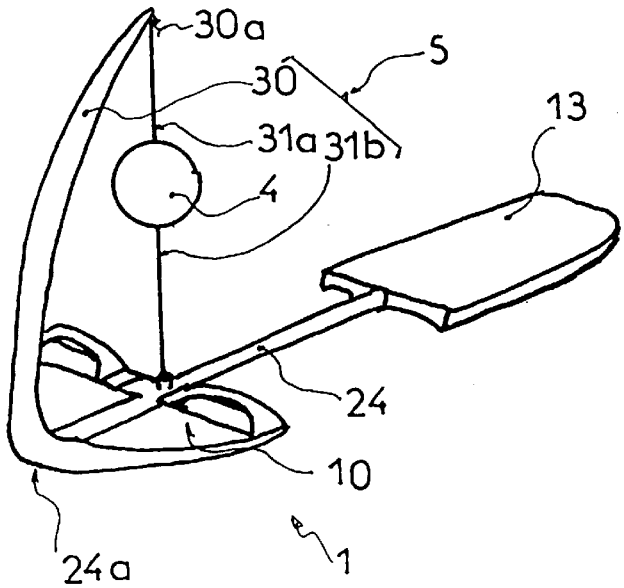
FIG. 6 is a perspective view of a variation of the embodiment of FIG. 5.

With reference to FIG. 6, in a variation on this embodiment, the foot receiving device 10 includes straps situated on a transverse support wall of the frame as described above. However, in this embodiment, the ball is supported at an adjustable height by a bracket 30 and semi-rigid straps 31*a*, 31*b*. The bracket takes the form a curved bar 30 which extends in an upward and rearward arcing direction from a front end 24*a* of the longitudinal bar 24. The ball is connected to the two semi-rigid straps which are connected one to the upper extremity 30*a* of the bracket 30 and the other to a point at a center zone of the longitudinal bar 24. Preferably, the straps 31*a*, 31*b* are of adjustable length such that the height of the ball is selectively adjustable.

Figure 7:
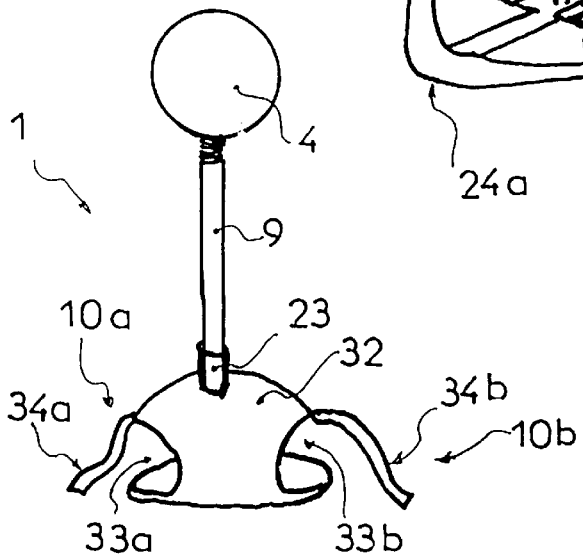
FIG. 7 illustrates another variation of the embodiment of FIG. 5.

With reference to FIG. 7, the tube portion 23 which carries the stem 9 on which the ball is supported is mounted directly on the base 32 or a pedestal which includes the foot positioning device 10*a*, 10*b* which is positioned on the ground. The base 32 preferably has a slightly hemispherical shape and is adapted to be weighted down, for example, filled with sand. It is fitted with two lateral openings 33*a*, 33*b* for receiving the feet of the user. The foot positioning devices takes the form of two holding straps 34*a*, 34*b* which immobilize the feet or ankles in the lateral openings.

Figure 8:
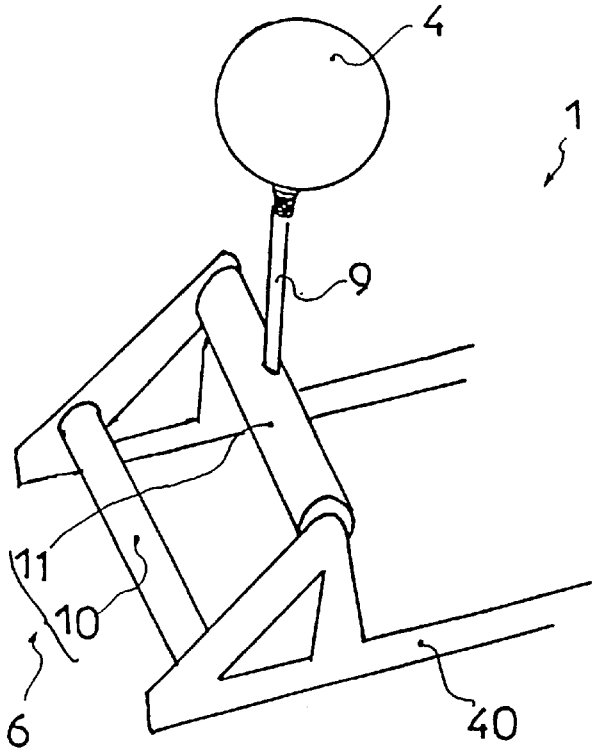
FIG. 8 is a perspective view of another alternate embodiment.

With reference to FIG. 8, the lower extremity positioning means 6 of the muscle exercise device includes both a foot or ankle positioning device 10 as well as a knee positioning device 11. The exercise device includes a frame structure 40 on which the ankle positioning cross piece 10 and the knee positioning cross piece 11 are mounted. The ankle holding cross piece is positioned in a slightly elevated fashion at the front of the structure in such a manner that the user's feet can pass below it. The ankle positioning device 10 abuts the upper surface of the ankle. The knee positioning device 11 includes a cross piece which is located slightly to the rear of the ankle retaining cross piece and is situated at an adjustable height to adapt to the morphology of the user. The knee positioning device includes a cross piece which is positioned to cooperate with the fold of the knee.

It should be noted that in this embodiment, the cross pieces are preferably cylindrical and have relatively soft coverings or padding to improve user comfort. The ball 4 is mounted on a ball support stem 9 which is connected to the knee positioning cross piece 11.

Figure 9:
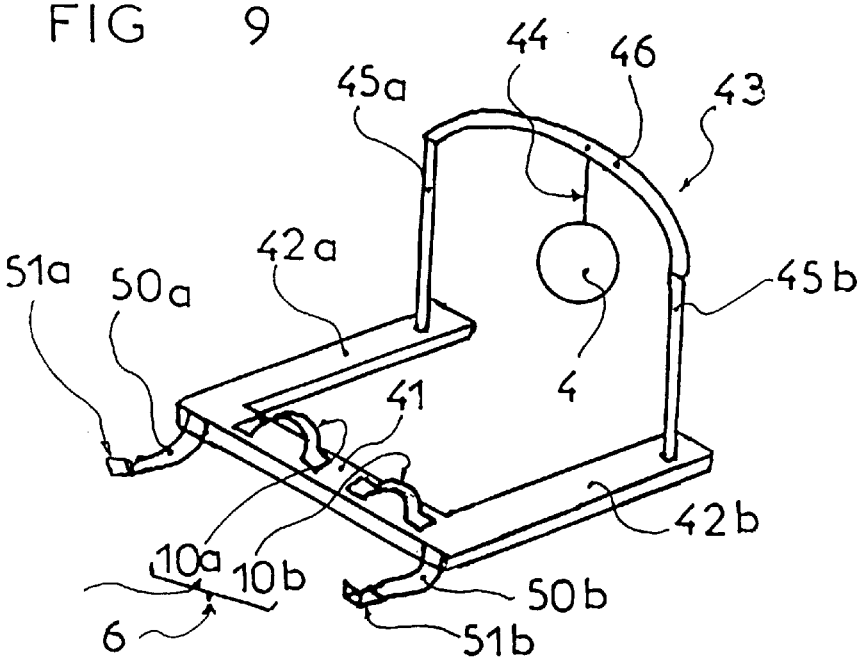
FIG. 9 is a perspective view of a variation of the third alternate embodiment.

With reference to FIG. 9, the foot positioning device 10 includes a pair of retention straps 10*a*, 10*b* positioned on a transverse front bar 41 of the frame. A pair of longitudinal frame bars 42*a*, 42*b* extend rearward from the transverse bar 41 to a cross bar 43 on which the ball 4 is suspended. The cross bar 23 includes two lateral bars 45*a*, 45*b* and an upper bar, preferably curved, from which the ball 4 is suspended by a flexible strap 44 or other connection means. The lateral bars 45*a*, 45*b* are optionally configured to support a knee retaining cross piece extending transversely therebetween at an adjustable height.

Optionally, the embodiments of FIGS. 8 or 9 can include anchoring means for anchoring the device more securely to the ground or other support surfaces in order to avoid untimely movements. Such anchoring means can, for example, include a pair of straps 50*a*, 50*b* positioned to a front part of the frame or structure of the device. The straps are fitted at their ends with catch feet 51*a*, 51*b* which are designed to be slid under an opening which is then closed. Of course, the anchoring means can also be constituted by any equivalent system without departing from the present invention.

Figure 10A:
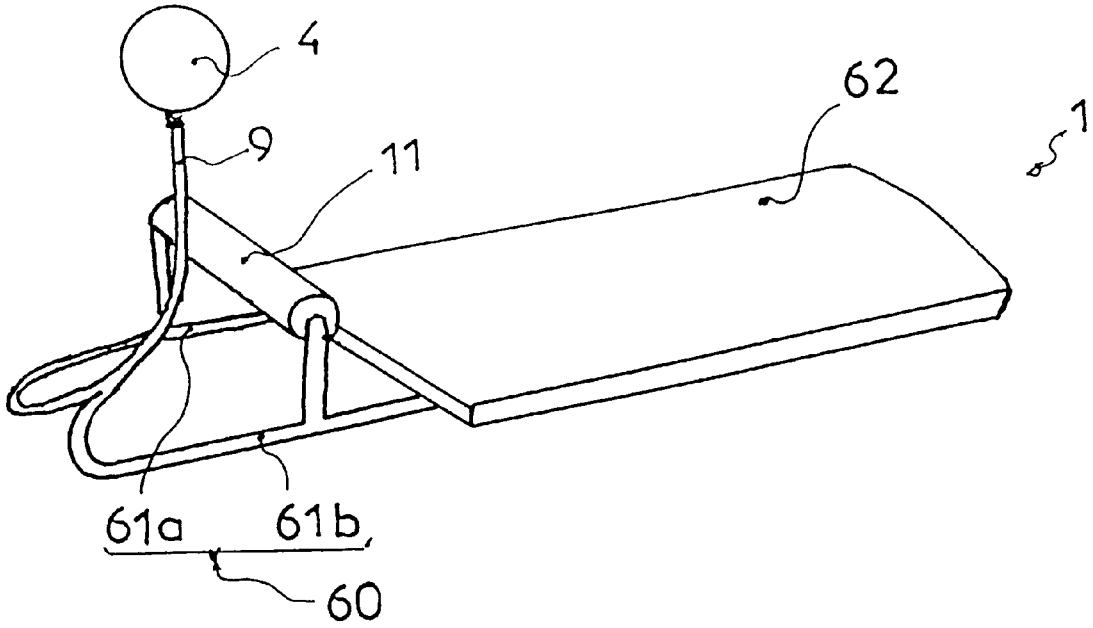
FIG. 10*a* is a perspective view of another alternate embodiment in a dorsal support position.
Figure 10B:
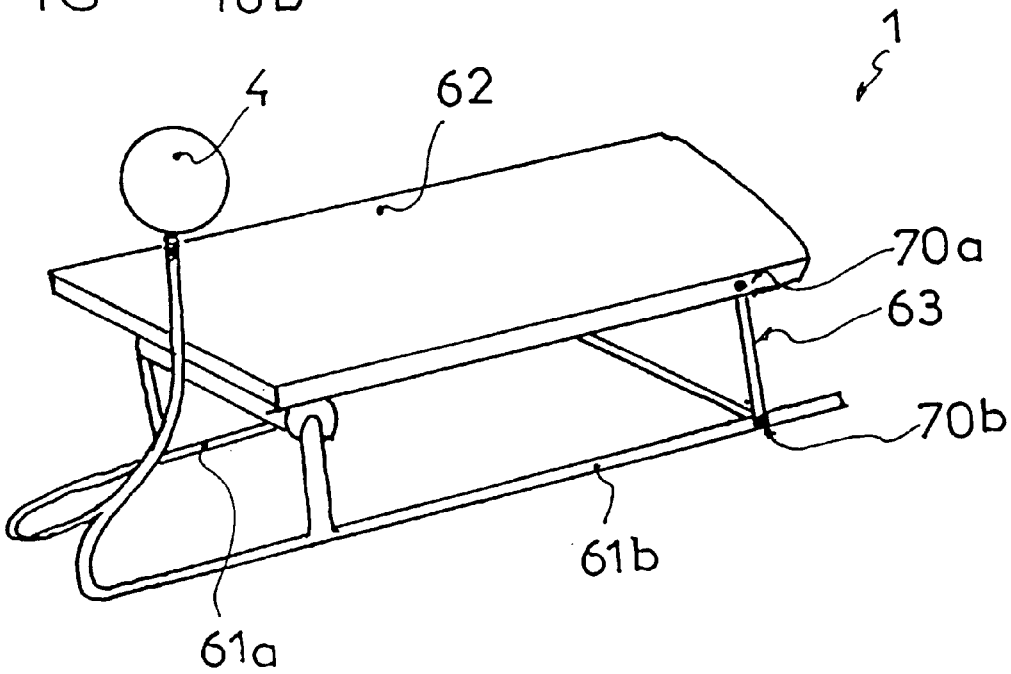
FIG. 10*b* is a perspective view of the embodiment of FIG. 10*a* in a back support position.

With reference to FIGS. 10*a* and 10*b*, the ball 4 and stem 9 is mounted on an elongated structure 60 including a pair of longitudinal bars 61*a*, 61*b*. A knee support cross piece 11 extends transversely in a horizontal plane above the bars 61*a*, 61*b* to provide a device for positioning the knees. A support surface 62 is movably arranged between a dorsal support position illustrated in FIG. 10*a* and a buttock support position illustrated in FIG. 10*b*. In the dorsal support position, the support surface 62 is folded down onto the longitudinal bar 61*a*, 61*b*. In the buttock support position, it is folded up and supported on the knee support cross piece and pivotal element 63 on a horizontal plane above the ground.

When the support surface 62 is disposed in the buttock support position of FIG. 10*b*, it constitutes a pelvis positioning device which allows the user to position its pelvis in order to arrange a sitting position as the active working position. It should be noted that the exercise device includes an actuation means in the form of an intermediate piece 63 connected between the support surface 62 and the longitudinal bars 61*a*, 61*b* by a pair of pivot connections 70*a*, 70*b*. A locking device, not shown, securely holds the support surface 62 in the buttock supporting position of FIG. 10*b*.

It is to be appreciated that the support surface can be configured specifically for dorsal support. It can also be equipped with an inclination adjustment means for adjusting its inclination to permit the user to adjust exercising positions. The inclination means can be achieved by a pivot connected to one side and an adjustable holding foot on the other.

Alternately, the device is equipped with electro-therapeutic elements, such as electrodes which are connected with a conventional electro-current supply device. In this manner, the user can combine standard muscle exercise with electro-therapy, as is known in the art.

Further, additional working elements can be combined with the described exercise device. For example, an electronic device may be combined which acts in the role of a metronome or muscle timing guide, a movement counting unit, or the like. The electronic device can have recreational use as well, such as to serve as a random indicator of movements to be performed and their rhythm.

Figure 11:
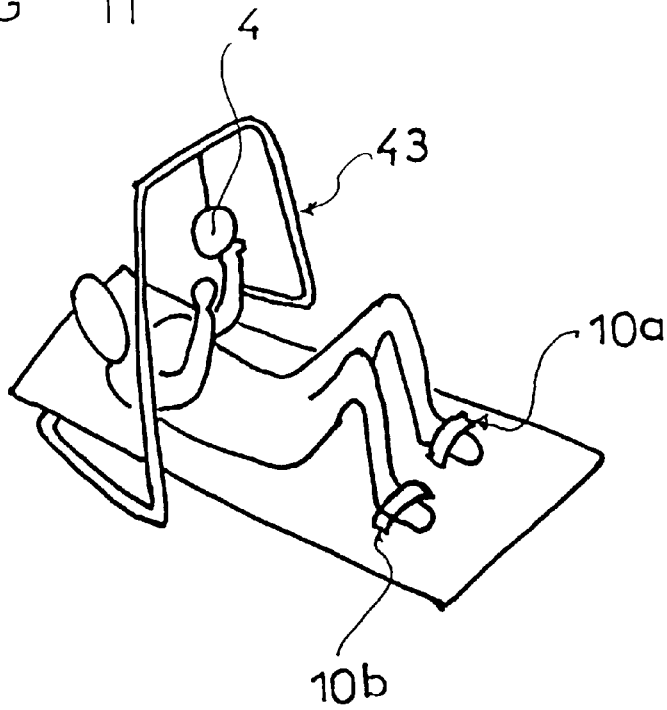
FIG. 11 is a perspective view illustrating use of one embodiment of the present invention.

With reference to FIG. 11, the cross bar 43 is positioned further from the foot retaining straps 10*a*, 10*b* than in FIG. 9 and arcs to a higher elevation. This enables the ball to be supported above the user.

Figure 12:
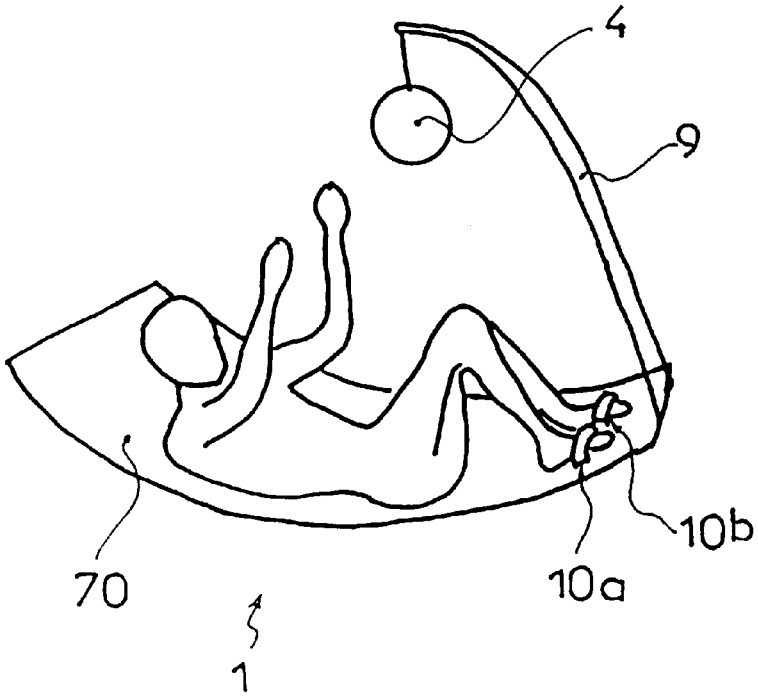
FIG. 12 illustrates another method of using the present device.

With reference to FIG. 12, the exercise device includes a mechanism for positioning the back and pelvis in the form of an inwardly curved rocking board 70. Foot holding straps 10*a*, 10*b* are connected to the rocking board. The working element or ball 4 is suspended above the user by an elongated stem 9.

Figure 13:
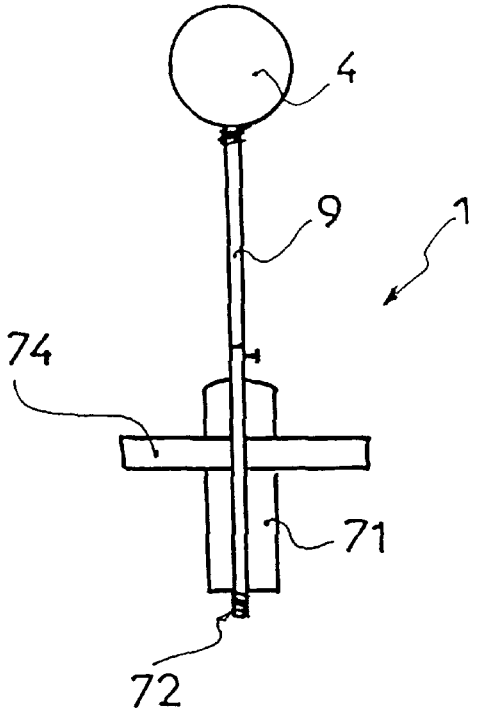
FIG. 13 is a transverse sectional view of another alternate embodiment; and, FIG. 14 is a perspective view of a variation on the embodiment of FIG. 13.
Figure 14:
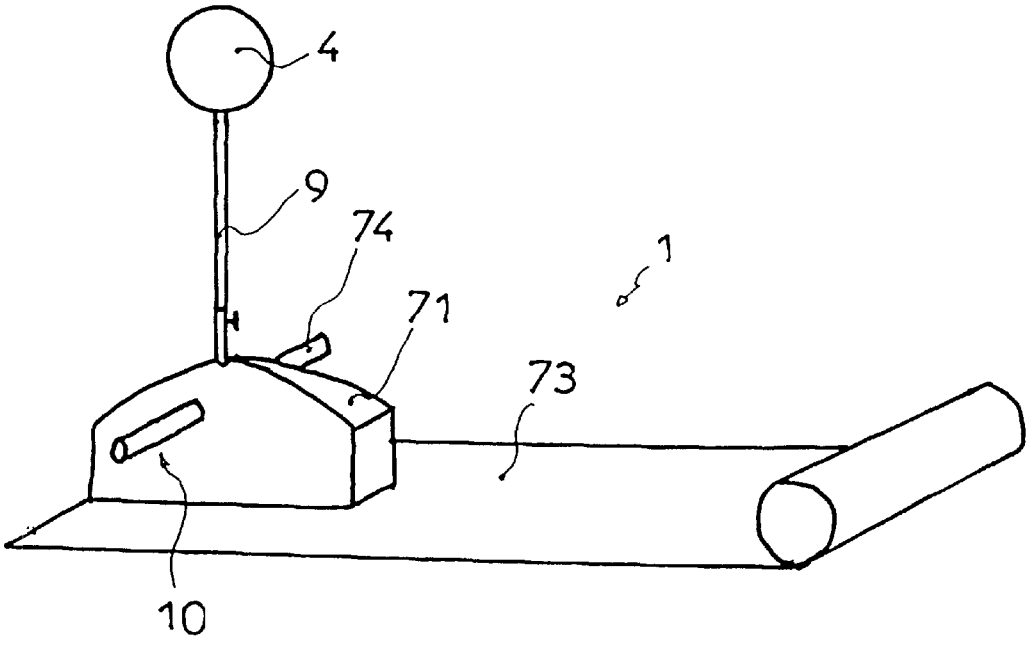

With reference to FIGS. 13 and 14, the muscle exercise device 1 includes a longitudinal strut 71 which the user holds between the knees in an active fashion to position the knees. The ball support stem 9 and the ball 4 are supported by the strut 71. An attachment device 72 connects the strut 71 with a carpet 73. Alternately, a transverse support bar 74 can be used to position the feet when the device is used in another mode. This strut can also be wedged between the feet or hands of the user as may the transverse bar 74.

Regardless of the selected mode of use, the stem which carries the ball is preferably arranged in such a manner so as to regulate its inclination in relationship to the other elements of the device. The invention may also include suitable carpet on which the user is positioned. The muscle exercise device may be foldable or taken apart for storage in a portable carrying case or similar accommodation.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A muscle exercise device for exercising abdominal muscles, the muscle exercising device comprising:

a working element including a ball;

a ball support for resiliently positioning the ball; and, a user member positioning means for positioning at least one of the user's feet, ankles, and knees in a preselected exercise position, the user member positioning means including a strut which engages both of the user's knees and which is connected with the ball support.

2. The muscle exercising device according to claim 1 wherein the ball support means includes a flexible stem which bends resiliently to permit movement of the ball.

3. The muscle exercise device according to claim 2 wherein the strut is of a prismatic shape.

4. The muscle exercise device according to claim 3 wherein the strut includes a foam portion which engages the user's knees to improve user comfort while performing exercises.

5. The muscle exercise device according to claim 1 wherein the user member positioning means includes a foam portion.

6. A muscle exercise device comprising:

a user lower limb positioning means for positioning the user's lower limbs in a preselected exercise position including a structure configured to engage preselected portions of both of a user's lower limbs to set a relative position between the user lower limb positioning means and the user's lower limbs;

a ball element;

a ball support means for supporting the ball in a selected position above the user's lower limbs in the exercise position for engaging an upper body portion of the user as the user bends forward in the selected exercise position.

7. The muscle exercise device as set forth in claim 6 wherein:

the user member positioning structure is configured further to engage one of the user's knees, ankles, and feet.

8. The muscle exercise device as set forth in claim 7 wherein the ball support structure includes:

a flexible stem for resiliently mounting the ball element above the ball support structure such that the ball element is resiliently displaceable in response to engagement by the user's upper body portion.

* * * * *